United States Patent [19]

Reuland

[11] 4,290,436

[45] Sep. 22, 1981

[54] METHOD AND APPARATUS FOR PRODUCING AN ELONGATED FILLER FROM FIBERS, ESPECIALLY TOBACCO FIBERS

[75] Inventor: Joachim Reuland, Neu Börnsen, Fed. Rep. of Germany

[73] Assignee: Hauni-Werke Körber & Co. KG, Hamburg, Fed. Rep. of Germany

[21] Appl. No.: 61,283

[22] Filed: Jul. 27, 1979

[30] Foreign Application Priority Data

Jul. 28, 1978 [DE] Fed. Rep. of Germany ..... 2833085

[51] Int. Cl.[3] ..... A24C 5/14; A24C 5/39

[52] U.S. Cl. ..... 131/108

[58] Field of Search ..... 131/84 R, 84 C, 21 B, 131/21 C, 21 D, 21 R

[56] References Cited

U.S. PATENT DOCUMENTS

| | | | |
|---|---|---|---|
| 3,750,675 | 8/1973 | Klemme | 131/21 B |
| 4,036,238 | 7/1977 | Okumoto | 131/21 B |
| 4,037,608 | 7/1977 | Wahle | 131/21 B |
| 4,190,061 | 2/1980 | Heitmann et al. | 131/21 B |

*Primary Examiner*—Stephen C. Pellegrino

*Attorney, Agent, or Firm*—Peter K. Kontler

[57] ABSTRACT

The making of an elongated tobacco stream which is to be densified, wrapped and severed for conversion into discrete cigarettes is controlled in dependence on the height of the stream prior to removal of the surplus of tobacco. The control may be influenced by a parameter, such as the flow resistance of the stream prior to equalization or the height of the equalized stream. The control determines the distance between the plane in which the equalizer removes the surplus from the stream and a conveyor which advances the stream. The control signal for the desired position of the plane may be formed as a function of more than one parameter.

38 Claims, 11 Drawing Figures

Fig. 2
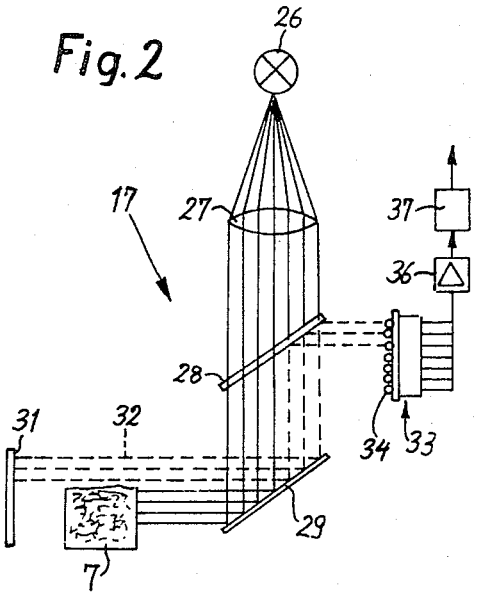
Fig. 3
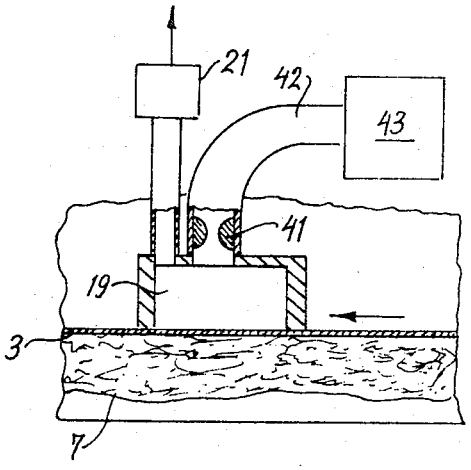
Fig. 7
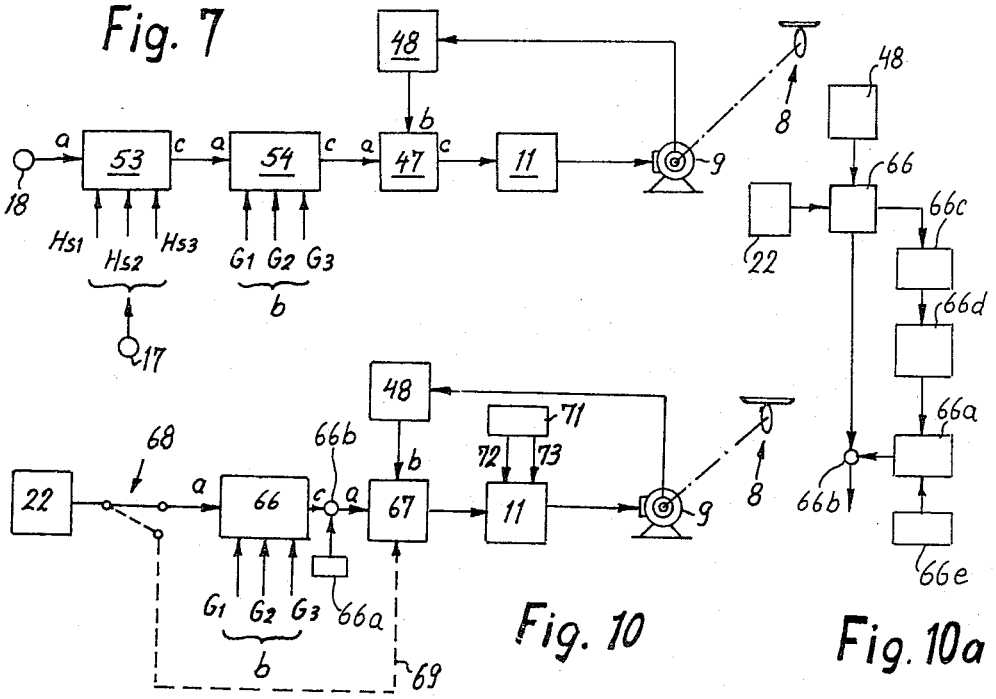
Fig. 10
Fig. 10a

METHOD AND APPARATUS FOR PRODUCING AN ELONGATED FILLER FROM FIBERS, ESPECIALLY TOBACCO FIBERS

BACKGROUND OF THE INVENTION

The invention relates to a method and an apparatus for producing an elongated filler from fibers, especially tobacco fibers. More particularly, the present invention relates to improvements in cigarette making machines and methods for producing cigarettes therein.

It is already known, particularly in the cigarette making industry, to form a stream from fibers, to advance the stream, to equalize the advancing stream by removing the surplus of fibers therefrom, and to densify and wrap the equalized stream to thereby form a filler (such as a cigarette rod from which individual cigarettes are to be severed). It is further known to control the removal of the surplus of fibers in dependence on a signal which is indicative of a parameter of the stream upstream of the equalizing location.

A conventional apparatus which is capable of performing such method includes a conveyor on which the stream is formed and by means of which the stream is advanced, an equalizer which removes the surplus of fibers from the advancing stream at a trimming station, a device for densifying the stream downstream of the equalizer and for wrapping the densified stream into a web, a device for monitoring a parameter of the stream upstream of the equalizing location, and a control arrangement which varies the distance between the equalizer and the conveyor in response to signals transmitted by the monitoring device.

The term "densification" is intended to denote the transformation of the equalized but unwrapped stream into its final shape with a cross section matching that of the wrapped tobacco filler (or cigarette rod) from which the individual cigarettes are severed on a continuing basis. Such conversion or transformation is performed by a so-called format garniture or wrapping mechanism wherein the tobacco is compressed during its passage therethrough and which, consequently, acts as a densifying arrangement. However, in the event that the tobacco in the tobacco stream is already considerably compressed during advancement to the equalizing location and/or the wrapping mechanism (for instance, by subjecting the tobacco stream, through the air-permeable conveyor advancing the same, to a pronounced suction), it can happen that the cross section of the equalized tobacco stream is the same or even smaller than the cross section of the cigarette rod. In this case, the expression "densification" is intended to mean the transformation of the tobacco filler into a body having the cross section of the wrapped cigarette rod. It is known to control the removal of tobacco fibers from a stream in dependence on the flow resistance of the stream. The signal denoting the resistance is formed in dependence on an air stream which is passed through (drawn) transversely of the tobacco stream upstream of the location of removal of surplus tobacco. The removal of the surplus is controlled by the signal in the sense of maintaining the flow resistance at a constant value.

It is further known to scan the surface of the tobacco stream by means of a photoelectronic system employing a roller which is pressed against the stream with a predetermined force and monitors the degree of densification which is dependent on the filling force of the tobacco. The signal then again serves to control the removal of tobacco fibers in the sense of maintaining the rigidity or hardness of the densified tobacco filler (cigarette rod) at a constant value.

Finally, it is known to photoelectronically sense the height of the tobacco stream and to control the so-called distributor of a cigarette making machine in dependence thereon, in order to maintain the height at a constant value. The surplus of tobacco fibers or shreds is removed from the tobacco stream for the purpose of maintaining its height at a constant value.

OBJECTS AND SUMMARY OF THE INVENTION

It is an object of the invention to provide a method of controlling the production of a cigarette rod or a similar elongated article which renders it possible to achieve constant hardness or rigidity of or a constant quantity of tobacco in the final product.

Another object of the present invention is to provide a method which is versatile and flexible and renders it possible to take into account various variable parameters of the stream which is used for the making of the final produce.

A concomitant object of the invention is to provide an apparatus for the practice of the above-mentioned method.

An additional object of the present invention is to provide an apparatus which is relatively simple, inexpensive, easy to operate and reliable.

One feature of the present invention resides in the provision of a method of making an elongated filler from fibers, especially from tobacco shreds, which comprises the steps of continuously forming from the fibers an elongated stream while longitudinally advancing the latter, equalizing the advancing stream by removing the surplus of fibers therefrom; densifying and wrapping the equalized stream to convert the same into a filler, generating a signal in dependence on the height of the stream prior to the equalizing step, and controlling the equalizing step in dependence on such signal.

A particular advantage of this method resides in that it provides for advance or anticipatory control of the position of the trimming plane in which the equalizing step is performed, that is, the position of such plane is changed in anticipation of the arrival of that section of the stream whose height has been measured to obtain the aforementioned signal.

The signal is preferably formed in a contactless manner, preferably optoelectronically. Thus, the stream may, depending on its height, more or less obstruct a light-electric receiver arrangement which then transmits an electric signal in dependence on the degree to which it is obstructed. The signal can be an analog or a digital signal.

It lies within the framework of the invention to form the height-dependent signal by resorting to other, preferably contactless, techniques, for instance, by resorting to known capacitive or pneumatic measuring methods.

In the event that the formation of a cigarette rod and thus of cigarettes having a constant rigidity or mass flow (density) is to be achieved with resort to the signal denoting the height of the equalized stream, the control signal is formed in dependence on the light indicating signal which is corrected in correspondence with a function that is selected for a desired value of the rigidity (hardness) or mass flow of the wrapped and densified stream (cigarette rod) and represents a predetermined relationship between the height of the equalized non-densified stream and the signal denoting the height of the stream. The control signal then serves for regulation (changing) of the distance betweeen the removal location and the conveyor for the tobacco stream in the sense of maintaining the rigidity or the mass flow of the wrapped stream at a constant value. For further influencing the removal of surplus tobacco fibers for the purpose of forming a cigarette rod of constant rigidity or density (mass flow), it is desirable to generate a second signal which denotes the flow resistance of the fibers between a surface of the non-equalized stream and the conveyor. This second signal can be formed by means of an air stream which is drawn through and transversely of the direction of advancement of the stream.

A combination of the two methods which have been mentioned previously, which is recommended for varying mass flow (density) and varying height of the non-equalized stream, can be achieved in that a signal corresponding to the density of the non-equalized stream is formed in accordance with a function which represents a predetermined relationship between the density and the height of the stream as well as the flow resistance, and in that the control signal for anticipatorily controlling the removal of fibers is obtained from the signal which denotes the density and is corrected in dependence on a function that is selected for a desired value of the rigidity or mass flow of the wrapped and densified stream (cigarette rod) and represents a predetermined relationship between the height of the equalized non-densified stream and the density.

A control signal which is transmitted by the above-mentioned monitoring device which are situated upstream of the location of removal of surplus fibers and serve for advance control of the removal of fibers can be transmitted as a desired value or reference signal to a position-regulating circuit for the equalizer. The circuit further receives an actual value signal which is formed in dependence on the height of the equalized non-densified stream. When the two signals differ, the position of the equalizer relative to the conveyor is changed.

The so-called "advance control" of the tobacco removal for the formation of a cigarette rod of constant rigidity (or density) in dependence on signals which are transmitted by the corresponding monitoring devices (height and/or flow resistance of the stream) which are located upstream of the removal location has the advantage that the tobacco stream can still be influenced when it reaches the removal location. A certain disadvantage of such advance controls (also referred to herein as anticipatory controls), which operate very quickly, is that the extent of intervention can slowly drift away from the desired value, inasmuch as no supervision takes place after the intervention. According to an important further development of the invention, this is avoided in that the removal of the surplus of tobacco is additionally controlled by a signal which is formed in dependence on a signal denoting to the mass flow (density) of the equalized stream, preferably after wrapping, wherein the signal denoting the mass flow is corrected in dependence on a function that is selected for a desired value of rigidity of the wrapped stream and represents a predetermined relationship between the height of the equalized non-densified stream and the signal denoting the mass flow.

The control signal can constitute the desired value signal in a position-regulating circuit for the removal plane, the actual value signal of which is formed in dependence on the height of the equalized non-densified stream. When the two signals differ, the position of the removal location relative to the conveyor is changed.

The sensing of the actual value of the height of the stream can take place in a contactless manner, e.g., optoelectronically. A particularly advantageous sensing of the actual value "strand height" resides in determination of the distance between the removal location and the conveyor, inasmuch as the removal location determines the height of the equalized non-densified stream.

The apparatus which is especially suited for the practice of the method according to the invention is characterized by a monitoring device the output signal of which depends on the height of the stream as measured at right angles to the direction of advancement of the stream (the distance between the surface of the stream and the conveyor).

An accurate and sensitive influencing of the tobacco stream, which is conveyed in modern machines at very high speeds, can be achieved by resorting to a contactless, preferably optoelectronic, monitoring device in which, for example, the stream obstructs the monitoring device to an extent depending on its height. The signal at the output of the monitoring device can be an analog signal commensurate to the height. However, one can also resort to a digital signal which denotes the height of the stream. This has the advantage of lower sensitivity to contamination of the optical system.

In the event that the formation of a cigarette rod and cigarettes having a to constant rigidity or mass flow (density) is to be accomlished by resorting to a signal which is transmitted by the device for monitoring the height of the stream, a function generator is connected to the monitoring device which latter is situated upstream of the removal location. The signal at the output of the function generator is formed in accordance with a function that, for the desired rigidity or mass flow of the densified and wrapped stream, represents a predetermined relationship between the height of the equalized non-densified stream and the signal which denotes the height of the non-equalized stream. The output signal is transmitted to the control arrangement and is used to regulate the the height of the equalized non-densified stream.

For further influencing of the removal of surplus tobacco for the purpose of forming a cigarette rod of a constant rigidity or density (mass flow), there can be provided a monitoring device which is mounted upstream of the removal location and senses the flow resistance of the fibers of the tobacco stream between its surface and the conveyor and which preferably comprises a suction chamber. The output signal of this monitoring device is transmittable to the control arrangement. Even here, a function generator is advantageously connected to the monitoring device. The signal at the output of the function generator is formed in accordance with a function which represents, for the desired rigidity or mass flow of the densified and wrapped stream, a predetermined relationship between the height of the equalized nondensified stream and the signal which denotes the flow resistance of the non-equalized stream. The output signal is transmitted to the control arrangement as a control signal for the height of the equalized non-densified stream.

A combination of the two control possibilities which have been mentioned before, which is recommended for varying mass flow (density) and varying height of the non-equalized stream can be achieved by connecting a function generator to the devices which monitor height of the stream and the flow resistance of the stream and are situated upstream of the removal location. The signal at the output of the function generator is formed in accordance with a function which represents, for the desired rigidity or mass flow of the densified and wrapped stream, a predetermined relationship between the density of the equalized non-densified stream and the signals denoting the height of the stream as well as the flow resistance of the non-equalized stream. The output signal is transmitted to a further function generator, the output signal of which corresponds to a function which represents, for the desired rigidity or mass flow of the densified and wrapped stream, a predetermined relationship between the height of the equalized non-densified stream and the values corresponding to the values of the non-equalized stream. The output signal of the further function generator is transmitted to the control arrangement as a control signal for the height of the equalized non-densified stream.

A control signal which is transmitted by the above-mentioned function generators can be transmitted to a position-regulating circuit for the removal location of the equalizer as a desired value signal. Then, a monitoring device which senses the height of the equalized non-densified stream and which can constitute a contactless measuring arrangement (preferably an optoelectronic measuring arrangement) or a measuring arrangement which senses the position of the equalizer relative to the strand conveyor, serves as an actual value signal generator.

A disadvantage of the above-mentioned so-called advance controls, particularly that the ascertained value of the rigidity or density of the stream slowly drifts away from the respective desired value, can be avoided by resorting to an additional device for monitoring the mass flow (density) of the equalized and preferably wrapped stream. The output of a function generator which is connected to this monitoring device transmits a signal which is formed in correspondence with a function representing, for a desired rigidity or mass flow of the densified and wrapped stream, a predetermined relationship between the height of the equalized non-densified stream and the signal denoting the mass flow. The output signal is transmitted to the control arrangement as a control signal for the height of the equalized non-densified stream. This intervention into the control constitutes a true regulation inasmuch as the just discussed signals are formed after the signals of the advance controls have already become effective. Thus, should there occur deviations which, generally speaking, constitute long-term variations, such deviations are sensed and eliminated by the regulation which operates somewhat more slowly than the advance controls.

Accordingly, the function generator of the above-mentioned device for monitoring the density of the wrapped stream is a desired value signal generator of a position-regulating circuit. A device which senses the height of the equalized stream and which can constitute a contactless measuring arrangement (preferably an optoelectronical measuring arrangement) or a measuring arrangement sensing the position of the equalizer relative to the conveyor, is suitable as an actual value signal generator of the position-regulating circuit.

This position-regulating circuit can be the same position-regulating circuit which receives desired value signals from the devices for monitoring the height and/or flow resistance of the non-equalized stream. The position-regulating circuit is then also supplied with an additional desired value signal from the device for monitoring the density of the wrapped cigarette rod.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a detail view of an optoelectronic scanning device for monitoring the height of the non-equalized stream;

FIG. 3 is a detail view of a pneumatic scanning device for monitoring the flow resistance of the non-equalized stream transversely of the direction of its advancement;

FIG. 7 shows a control arrangement for influencing the formation of the stream for the purpose of achieving constant rigidity (or constant quantity of tobacco) in the cigarettes in dependence on the height and the flow resistance of the non-equalized stream;

FIG. 10 shows a regulating arrangement for influencing the formation of the stream for the purpose of achieving constant rigidity (or constant quantity of tobacco) in the cigarettes in dependence on the density of the equalized, densified wrapped cigarette rod; and FIG. 10*a* shows a modification of the regulating arrangement of FIG. 10.

DESCRIPTION OF THE PREFERRED EMBODIMENTS

Figure 1:
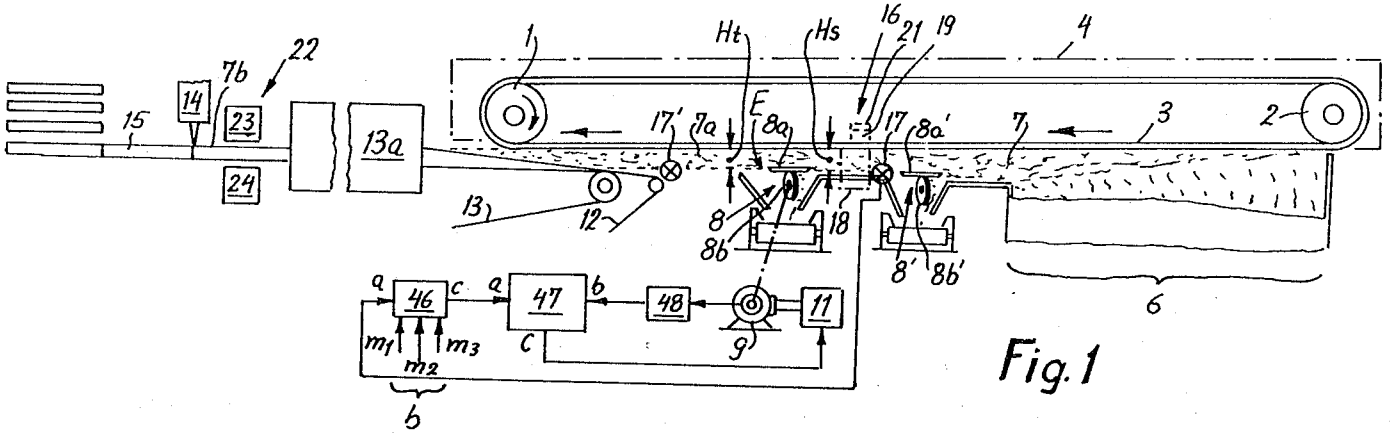
FIG. 1 is a somewhat diagrammatic view of the stream building zone in a cigarette making machine which is equipped with a control arrangement for influencing the formation of the cigarette rod for the purpose of achieving a constant rigidity (or quantity of tobacco) in the cigarettes in dependence on a measurement of the height of the stream.

Referring to FIG. 1, the reference numeral 3 denotes an air-permeable conveyor belt having a lower reach which is adjacent to the underside of a suction chamber 4. The conveyor belt 3 is trained about rollers 1 and 2, and travels above a stream building zone 6 in which fibers (e.g., shreds of tobacco) ascend (in that they are either mechanically flung up, e.g., by means of a brush, or transported by means of an air stream), and become and remain suspended, due to the suction in the chamber 4, at the underside of the conveyor belt 3 in the form of a non-equalized stream 7. The conveyor belt 3 then advances the tobacco stream past a known equalizer 8 which removes the surplus of tobacco from the downwardly facing exposed surface of the tobacco stream 7. The equalizer 8 may include a rotating circular knife which cooperates with a serrated wheel. However, equalizer can also be provided with clamping discs 8*a* wherein the surplus of tobacco is removed by a brush 8*b* (or a paddle wheel). Details of an equalizing arrangement of the last-mentioned type are disclosed, for instance, in U.S. Pat. No. 3,030,966.

The distance between the removal location (cutting or trimming plane) E of the equalizer 8 and the conveyor belt 3 is adjustable by means of a controllable drive 9 (positioning motor) which is controlled by a control arrangement 11.

An equalized non-densified tobacco stream or filler 7*a* is transferred onto a wrapping web 12 (in general, a paper strip), and is advanced by a garniture 13 through a wrapping mechanism 13*a* in which the tobacco filler 7*a* is densified and the web 12 is draped around the tobacco filler and glued for forming a cigarette rod 7*b*.

In the event that the tobacco filler 7*a* is densified to, or even below, the cross section of the cigarette rod 7*b*, which can occur, for instance, as a result of high compression due to a very pronounced suction in the chamber 4, the wrapping mechanism 13*a* merely transforms the tobacco filler 7*a* into the generally round cigarette rod 7*b*. Such possibility, too, is intended to be embraced by the expression "densification".

Downstream of the wrapping mechanism 13*a*, cigarettes 15 are severed, from the cigarette rod 7*b* by a cutoff 14 and are conveyed away for further processing. A monitoring device 16 is mounted upstream of the equalizer 8. This device may comprise an optoelectronic arrangement 17 for scanning the height of the non-equalized tobacco stream 7 (and thus the distance between the exposed surface of the stream and the conveyor belt 3). Details of this optoelectronic scanning arrangement are shown in FIG. 2. The monitoring device 16 can also include a pneumatic arrangement 18 for measuring the flow resistance of the tobacco fibers transversely of the direction of advancement of the tobacco stream, that is, in a direction toward the conveyor belt 3. FIG. 3 shows details of the measuring arrangement 18. However, the monitoring device 16 can also include both arrangements 17 and 18.

The arrangement 18, of which details can be seen in FIG. 3, preferably includes a suction chamber 19 at that side of the conveyor belt 3 which faces away from the tobacco stream 7. The air stream or current which flows through the tobacco stream 7 and the conveyor belt 3, and thus the pressure in the chamber 19, is dependent on the flow resistance of the tobacco fibers of the non-equalized tobacco stream 7. An electric signal corresponding to the pressure can be formed by means of a pressure sensitive semiconductor or a diaphragm transducer 21 which is known from the field of measuring pneumatic values.

A further monitoring device 22 is mounted downstream of the equalizer 8 and transmits a signal which denotes the density of the tobacco stream which has been densified to a constant cross section, namely, the density of the wrapped cigarette rod 7*b*. Advantageously, the monitoring device 22 is a known beta-ray detector with an emitter 23 containing a radioactive preparation and capable of emitting beta-rays, and with a receiver 24, for example, an ionization chamber.

FIG. 2 shows details of the optoelectronic device 13 for monitoring the height of the non-equalized tobacco stream 7. A light source 26 transmits, via lens 27, parallel light rays through a partially light-transmitting mirror 28 and, via reflecting mirror 29, further onto a reflecting mirror 31. The tobacco stream 7 is advanced at right angles to the plane of FIG. 2 across the path of light between the mirrors 31 and the mirrors 29. In the illustrated embodiment the tobacco stream 7 covers the light only in part, so that some of the light rays, namely, the rays 32 bypassing the tobacco stream 7 and denoted by broken lines, reach the mirror 31 while the remaining rays which are illustrated in full lines are intercepted by the tobacco stream 7. The reflected light rays 32 return to the mirror 28 which directs them to a light-electrical receiver 33. The latter includes a plurality of light-electric elements (e.g., phototransistors) 34 which are stacked one above the other; in the illustrated embodiment, there are provided seven phototransistors. The non-covered upper part of the tobacco stream 7 is monitored by three phototransistors 34 which receive the reflected light rays 32. The three signals for the height of the tobacco stream 7 upstream of the equalizer 8, which are received in this manner by the receiver 33, are amplified by an amplifier 36 and summed by means of totalizing circuit 37. The signal at the output of the circuit 37 thus constitutes a measure for the height of the tobacco stream 7.

Instead of an analog output signal, the optoelectronic monitoring device 17 can also transmit a digital output signal in that the individual light-electric elements 34 can correspond to certain digits of a number which is arrived at, for instance, in a binary manner.

FIG. 3 shows details of the pneumatic arrangement 18, in which a signal corresponding to the flow resistance of the non-equalized tobacco stream 7 transversely to the direction of its advancement is formed. The suction chamber 19 is located at that side of the air-permeable conveyor belt 3 which faces away from the tobacco stream 7 and is connected with a suction generating device 43 by way of a flow restrictor 41 and a conduit 42. Further connected to the suction chamber 19 is a transducer in the form of a diaphragm transducer 21 which is known from the field of measuring subatmospheric pressure, and converts the value of the pressure in the suction chamber 19 into an electrical signal. The pressure, in turn, is dependent on the resistance which the tobacco stream 7 offers to the flow of the air current or stream from the exposed surface of the tobacco stream 7 through the latter and through the air-permeable conveyor belt 3 into the suction chamber 19.

The signal which is transmitted by the monitoring device 17 and corresponds to the height of the non-equalized tobacco stream 7, is transmitted, as indicated in FIG. 1, to the input a of a function generator 46 in which the value pairs for different distances between the location (cutting plane) E of the equalizer 8 and the conveyor belt 3 and thus for the height Ht (FIG. 4) of the equalized non-densified tobacco stream 7*a* in dependence on the height Hs of the non-equalized tobacco stream 7 are stored. It is assumed here that the stream building zone 6 receives tobacco at least approximately at a constant rate so that the quantity of tobacco per unit of length of the non-equalized tobacco stream 7 is at least approximately constant.

Figure 4:
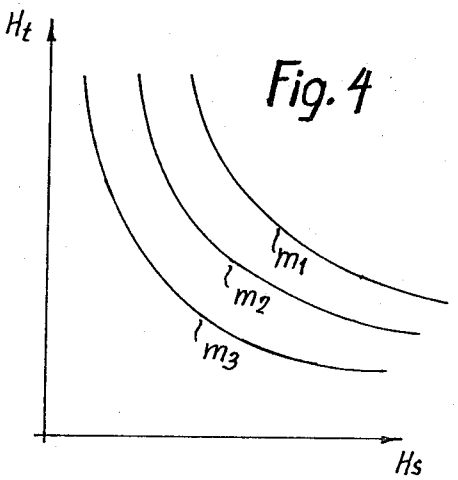
FIG. 4 is a diagram depicting the functional relationship between the height of the non-equalized stream and the height of the equalized non-densified stream.

In this case, the arrangement 18 can be omitted. The function generator 46 can receive for further influencing, besides the signals corresponding to the height Hs, signals via corresponding inputs b which correspond to different, but always constant, tobacco amounts m1, m2, m3 per unit length of the stream and wherein m1 corresponds to large and m3 to small amounts. The relationship which is established by the function generator 46 between input signals Hs, amount-dependent signals m1, m2, m3 and height Ht of the equalized non-densified tobacco stream or filler 7*a* for the formation of the cigarette rod 7*b*, and thus for the manufacture of cigarettes of constant rigidity, is shown in the diagram of FIG. 4.

The signal Ht at the output c of the function generator 46 is an analog signal or a signal which is calculated in a digital manner in accordance with a program corresponding to a predetermined function. This signal serves to control the removal of tobacco fibers in the sense of ensuring a constant "filling force" or "rigidity" (hardness) of the equalized, wrapped and densified tobacco filler (cigarette rod 7*b*) and of the cigarettes 15. The above-mentioned expressions are intended to denote the resistance which the cigarette offers to deformation in the elastic region, for instance, by a force applied by a constant weight or by the fingers of the smoker. This resistance is dependent on various influencing values such as the elasticity of the fibers, the amount and/or the type of tobacco, etc. The smoker judges the quality of the cigarette predominantly in accordance with this "rigidity" inasmuch as he or she cannot examine the constancy of the quantity of tobacco contained in a cigarette, in accordance with which the cigarettes have heretofore been controlled. Nevertheless, the function generator 46 can also be constructed in such a way that the signal at its output c serves to control the removal of tobacco fibers to ensure a constant quantity of tobacco in the finished cigarettes. Then, the functional relationship between Hs and Ht conforms to this changed control value "tobacco quantity or amount" (instead of "rigidity").

The signal at the output c of the function generator 46 is transmitted as a desired value signal to a regulating circuit for the height Ht of the equalized non-densified filler or stream 7*a*. Advantageously, a position-regulating circuit for the cutting plane E of the equalizer 8 is suited for this purpose, inasmuch as it simultaneously determines the height of the equalized non-densified tobacco filler 7*a*. To this end, the signal at the output c of the function generator 46 is transmitted as a desired value signal to the input a of a signal comparing member or stage 47 of the position-regulating circuit. A second input b of the comparing member 47 receives a signal which corresponds to the height Ht of the equalized non-densified filler 7*a*. This signal can be transmitted by an optoelectronic monitoring device 17′ which has been illustrated only in a diagrammatic manner and which can be constructed in the same way as that illustrated in FIG. 2. However, it is more advantageous to form the signal in dependence on the position of the cutting plane E of the equalizer 8, inasmuch as the latter is simultaneously a measure for the height of the equalized non-densified tobacco filler 7*a*. To this end, there is provided a height-measuring monitoring device 48 which is mounted on the equalizer 8 and the output signal of which is applied to the input b of the comparing member 47. The monitoring device 48 can be a well known, e.g., inductively operating, displacement measuring generator in which a piece of iron influences the inductance of a coil in accordance with the position of the former.

Signals denoting the difference between the two signals which are supplied to the comparing member 47 are transmitted as a regulating deviation to the control arrangement 11 which controls the drive (positioning motor) 9 of the equalizer 8 in such a manner that the removal location (cutting plane) E coincides with a position represented by the control signal Ht (desired value signal for the position-regulating circuit) transmitted by the function generator 46.

The described control thus operates as a so-called "advance control" (also referred to herein as "anticipatory control") for maintaining the rigidity or hardness of the finished cigarettes at a constant value.

A further advance or anticipatory control of the cutting plane E of the equalizer 8 to ensure contant rigidity (or constant weight) of the finished cigarettes is possible in dependence on signals transmitted by the arrangement 18 (FIG. 3). Herein, however, it is necessary that the height Hs of the non-equalized tobacco stream 7 is at least approximately constant. Then, the monitoring 17 for the height of the non-equalized tobacco stream 7 can be omitted.

Figure 5:
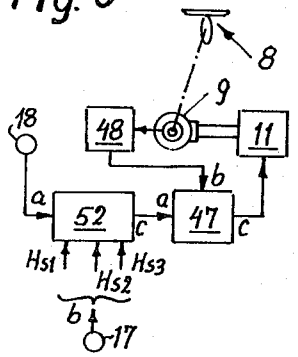
FIG. 5 shows a control arrangement for influencing the formation of the stream for the purpose of achieving a constant rigidity (or constant quantity of tobacco) in the cigarettes in dependence on the flow resistance of the tobacco stream transversely of the direction of its advancement.

As illustrated in FIG. 5, the signal which is transmitted by the arrangement 18 and corresponds to the flow resistance Rg (FIG. 6) of the tobacco stream 7 between its exposed surface and the suction chamber 19 is transmitted to the input a of a function generator 52 in which there are stored value pairs for different distances between the cutting plane E of the equalizer 8 and the conveyor belt 3, and thus of the height Ht of the equalized non-densified tobacco filler 7*a*, in dependence on the flow resistance Rg of the non-equalized tobacco stream 7. To the function generator 52, there can be supplied for further influencing, besides the signals corresponding to the flow resistance Rg, signals via corresponding inputs b which correspond to different, but always constant, heights Hs1, Hs2, Hs3 of the tobacco stream 7. Hs3 corresponds to small and Hs1 to large heights.

Figure 6:
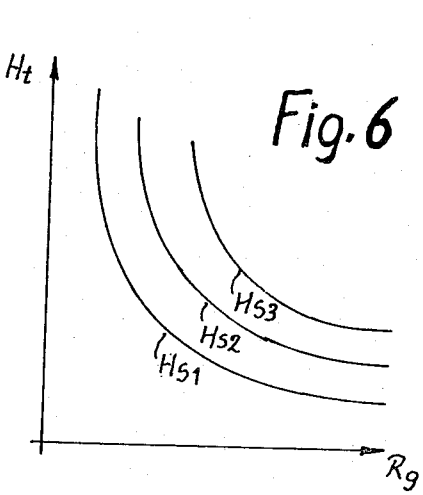
FIG. 6 is a diagram showing the functional relationship between the flow resistance of the non-equalized stream and the height of the equalized non-densified stream.

The relationship, which is established by the function generator 52 between the input signals Rg, the height-dependent signals Hs1, Hs2, Hs3, and the height Ht of the equalized non-densified tobacco filler 7*a* for the formation of a cigarette rod 7*b* and thus for the reduction of cigarettes of constant rigidity, is illustrated in the diagram of FIG. 6.

The output signal Ht which is formed by the function generator 52 in an analog manner or which is digitally calculated in accordance with a program corresponding to a predetermined function, and which appears at the output c of the function generator 52 serves for the control of removal of tobacco fibers to achieve constant rigidity of the cigarette rod 7*b* and thus of the cigarettes 15. To this end, the output signal is again transmitted as a desired value signal to the input a of the signal comparing member or stage 47 of a position-regulating circuit for the distance between the removal location E and the conveyor belt 3. An actual value signal is supplied as a measure for the height Ht of the equalized tobacco filler *7a* to the input b of the comparing member 47. This actual value signal is again preferably generated in dependence on the position of the cutting plane E as determined by a monitoring device or detector 48 for its height. A signal denoting a possible difference between the two signals which are supplied to the inputs of the comparing member 47 controls, via control arrangement 11 and positioning motor 9, the cutting plane E to maintain that value Ht which is selected by the desired value signal.

Even in this kind of advance control (anticipatory control), the functional relationship between Rg and Ht can be so selected that the quantity of tobacco in the cigarette rod *7b* (per unit length) and thus in the cigarettes 15 is maintained at a constant value.

If the height of the supplied tobacco stream 7 is not constant, a further equalizer 8' with clamping discs 8a' and a brush 8b' (FIG. 1) can be provided for preliminary equalization, upstream of the arrangement 18 so that the tobacco stream 7 which reaches the arrangement 18 has a constant height Hs.

When the conditions of the constant height Hs and the constant amount of tobacco, which are needed for the various controls of the equalizer 8 to ensure constant rigidity of the produced cigarettes (or constant quantities of tobacco in the cigarettes) are not satisfied and, instead, pronounced deviations are encountered, then, according to a further development of the invention which is illustrated in FIG. 7, the control of the position of the equalizer 8 can be accomplished by the signal which is transmitted by the monitoring device 17 as well as in dependence on the signal from the arrangement 18.

The signal which is transmitted by the arrangement 18 and depends on the flow resistance is used, in this embodiment of the invention, to first establish the density Du (FIG. 8) of the non-equalized tobacco stream 7. To this end, the electrical signal corresponding to the flow resistance Rg and transmitted by the arrangement 18, and the electrical signals Hs1, Hs2, Hs3 corresponding to the height of the stream and transmitted by the monitoring device 17, are applied to the input a or inputs b of a function generator 53 whose output c, in correspondence with part I of the diagram in FIG. 8, transmits a signal which corresponds to the density Du of the non-equalized stream 7.

Figure 8:
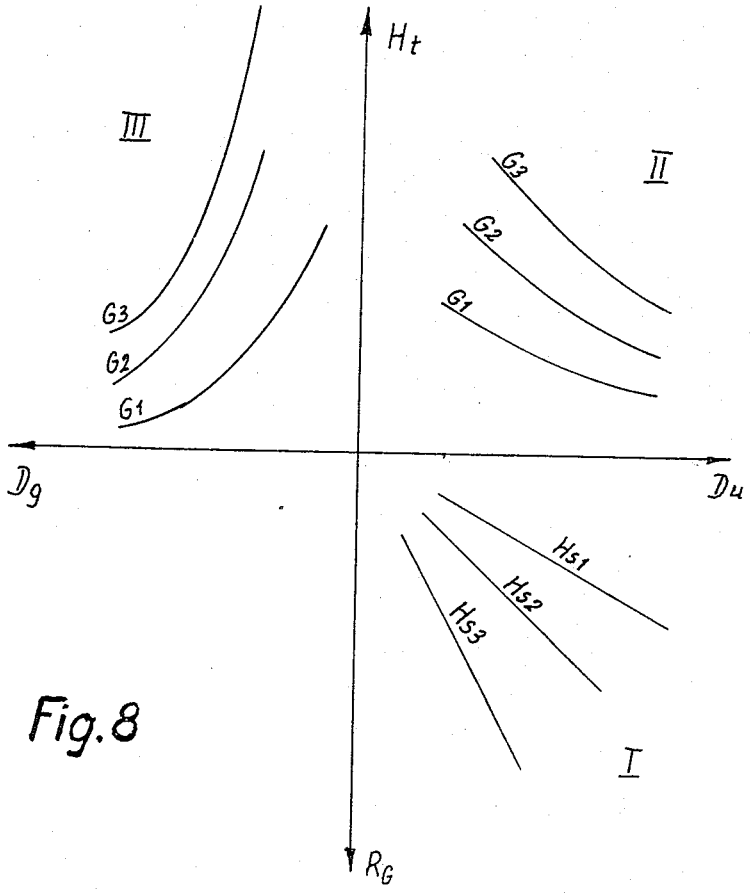
FIG. 8 is a diagram showing the functional relationship between the density of the stream as established from the signals denoting the height and the flow resistance of the stream, and the functional relationship between the density of the stream and the height of the equalized non-densified stream in dependence on different cigarette rigidities.

In part I of FIG. 8, there are illustrated curves for the functional relationship between the flow resistance Rg and the density Du for different heights Hs1 (small), Hs2 (intermediate) and Hs3 (large) of the non-equalized stream 7.

The signal at the output c of the function generator 53 corresponds to the density Du and is transmitted to the input a of a further function generator 54 to the input b of which there can be applied signals denoting certain values for the desired rigidity (or quantity of tobacco) of (or in) the cigarette *7b*.

Part II of the diagram of FIG. 8 depicts the functional relationship between the density values Du of the non-equalized tobacco stream 7 and the positions of the cutting plane Ht of the equalizer 8 in order to obtain certain rigidity values G1 (soft), G2 (intermediate), G3 (rigid) and so on, which are to remain constant in the cigarettes (instead of the rigidity values, curves with desired different tobacco quantities, which are to be held constant, can be selected to control such quantities).

The operation of the function generators 53, 54 is similar to that of the function generator 46 of FIG. 1. The outputs c of these function generators transmit analog but preferably digital signals for each value at their inputs a and in additional dependence on additional parameters denoted by signals applied to the inputs b corresponding to their respectively predetermined functional relationships. Such output signals then serve for the control of removal of tobacco fibers to form a cigarette rod *7b* and cigarettes of constant rigidity (or constant quantity of tobacco).

The signal at the output c of the function generator 54 is transmitted as a desired value signal to the input a of the signal comparing member or stage 47 which is associated with the position-regulating circuit 11 and to the input b of which there is applied an actual value signal for the height Ht of the equalized filler *7a;* this signal is again transmitted by the device 48 which monitors the distance between the equalizer 8 (that is, its cutting plane E) and the conveyor belt 3. A signal denoting a possible difference between the two signals transmitted to the comparing member 47 then controls, via control arrangement 11 and positioning motor 9, the distance between the equalizer 8 and the conveyor belt 3 to ensure that the value Ht which is selected by the desired value signal remains constant.

In the above-described manner, the location (cutting plane) E of the equalizer 8 is so anticipatorilly controlled in dependence on the height Hs of the non-equalized tobacco stream which height is determined in an optoelectronic manner, and additionally on the flow resistance Rg of the fibers in the non-equalized stream 7, as measured transversely to the direction of advancement of the stream, that the rigidity of the cigarettes 15 is at least approximately constant even though the height Hs of the non-equalized tobacco stream 7, as well as the quantity of tobacco therein, can vary. As already explained previously, the circuitry can be modified, in correspondence with other parameters in the function generators 53 and 54, in such a way that one can achieve an anticipatory control which ensures a constant quantities of tobacco in the cigarettes 15.

Figure 9:
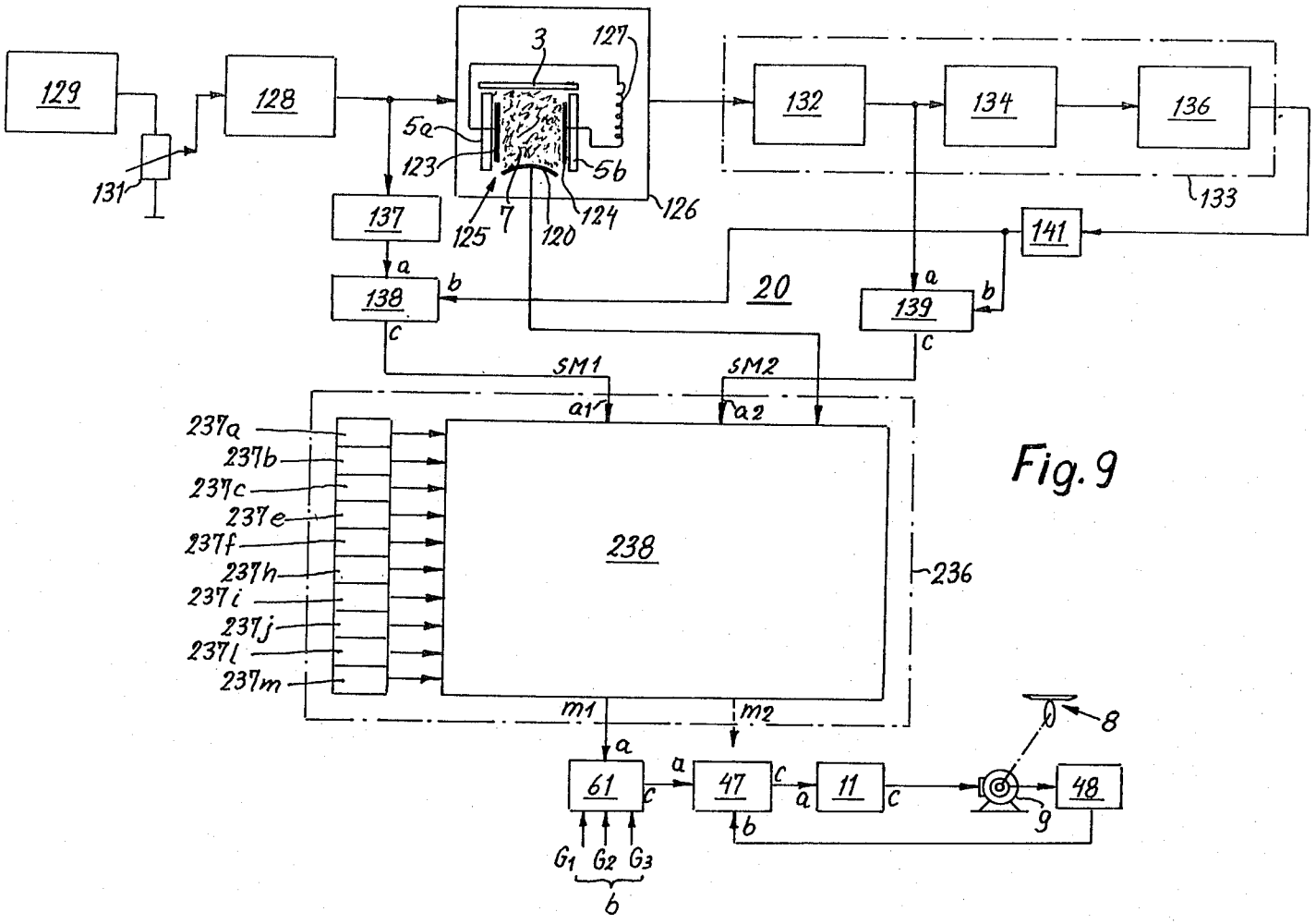
FIG. 9 shows a capacitive device for monitoring the density of the stream.

A further possibility of measuring of the density the non-equalized tobacco stream is shown in FIG. 9. In this example, the density is determined not by way of the height and the flow resistance of the non-equalized tobacco stream 7 which is advanced by the conveyor belt 3 between stationary walls 5a and *b*, but rather in a capacitive manner. The measuring location is again located upstream of the equalizer 8 (FIG. 1). The capacitive monotoring device of FIG. 9 thus replaces the device 17 and arrangement 18.

FIG. 9 shows a capacitive monitoring device 20 for the determination of the density M1 of the tobacco stream 7, and the amount of moisture (M2) contained in the tobacco. The electrodes 123 and 124 of a measuring capacitor 125 are located at the opposite sides of the tobacco stream 7 so that they, when supplied with voltage, generate a homogeneous electrical field. The measuring capacitor 125 forms the capacitance of an electrical high-frequency oscillating circuit 126 which additionally includes a coil 127. The ohmic resistance of the oscillating circuit 126 is not shown.

The oscillating circuit 126 incorporates a carrier frequency oscillator 128 which is controllable as to its frequency and oscillates at a basic frequency of 10 MHz. This frequency is so controllable by a control oscillator 129 of 1 KHz that the frequency of the carrier frequency oscillator 128 is periodically varied (wobbled) about the basic frequency between two extreme values. The extent of frequency variations between the extreme values is selected in such a way that it invariably suffices to let the oscillating circuit 126 come in resonance once during each passage of the frequencies of the oscillator 128 between the extreme values. The control of the oscillator 128 takes place by means of the amplitude of the constant frequency of 1 KHz of the control oscillator 129 which is adjustable by means of a potentiometer 131.

Thus, the distance between the extreme values of the frequencies of the oscillator 128 can be adjusted via amplitude. The basic frequency of 10 MHz of the oscillator 128 and thus of the oscillating circuit 126 is sufficiently high in order to achieve large signal magnitudes.

An amplitude measuring arrangement 133, which consists of a demodulation stage 132, a differentiating stage 134, and a comparing stage 136, is connected to the oscillating circuit 126. The demodulation stage 132 forms an envelope curve of the high-frequency voltage of the circuit 126 and transmits signals to the differentiating stage 134 which transmits a zero signal at the occurrence of an extreme value (e.g., maximum) of the demodulated voltage. The comparing stage 136 establishes, when the differentiated voltage (a time derivative) of the voltage increase is "zero", which means that the demodulated voltage of the oscillating circuit 126, which is applied by the demodulation stage 132, has a maximum value at such time. At this instant of time, the comparing stage 136 transmits an output signal which is applied to a monostable multivibrator 141.

A discriminating stage 137 which forms, together with the differentiating stage 134 and the comparing stage 136, a resonance frequency measuring arrangement, receives the high-frequency voltage signals from the oscillator 128 which also supplies such signals to the oscillating circuit 126, and the stage 137 transmits an output signal, which is proportionate to the frequency of the input signal, to an input a of a storage member 138. The signal at the output of the demodulation stage 132 is applied to the input a of a further storage member 139. The transfer of signals from the inputs a of the storage member 138 and 139 into the storage members 138 and 139 is controlled by a control signal which is applied to the inputs b of the storage members 138 and 139. This signal is furnished by a monostable multivibrator 141 which is connected to the comparing stage 136 and transmits, after activation via output signal of the comparing stage 136, a signal of an exactly defined pitch and length so that it acts as a pulse forming stage. The comparing stage 136 transmits a control signal at the instant when the oscillating circuit is at resonance, which is determined by means of the differentiating stage 134 from the maximum conditions. Therefore, the signals at the inputs of the storage members 138 and 139 at the time of transfer correspond to the frequency and the damping of the oscillating circuit 126 when the latter is in resonance.

The amplitude of the current of the control oscillator 129 which oscillates at 1 KHz is controllable by means of the potentiometer 131. The effective capacitance of a capacitance diode (not illustrated) in the oscillator 128 and thus the difference (in the example 1 MHz) between the extreme values which the frequency of the voltage of the oscillator 128 can take from the basic value of 10 MHz, can be controlled via different amplitudes. At the basic frequency of 10 MHz in the oscillator 128, which has been given as an example, the periodic frequency variations of the oscillator 128 can amount to, e.g., $\pm 1$ MHz, so that the frequency of the high-frequency voltage which is applied to the oscillating circuit 126 is periodically varied (wobbled) (with the frequency of 1 KHz) between the extreme values 9 and 11 MHz. The oscillating circuit 126 is provided with a coupling coil (not illustrated), which simultaneously constitutes the oscillating circuit inductance, and the measuring capacitor 125 with the tobacco stream 7 situated between the electrodes 123 and 124, which forms the capacitor of the oscillating circuit.

The comparing stage 136 includes a resistance (not illustrated) and an operational amplifier (not illustrated) with a very steep characteristic line, which amplifier, consequently, has practically a switching behavior and achieves its end value even at very small input signals. A signal change is converted, by the monostable multivibrator 141 which is connected to the amplifier, into a signal of an exact duration and pitch.

The discriminating stage 137 has a special switching element which incorporates a circuit with a resistance, capacitor and a throttling coil, e.g., of the type TAA 661 produced by the firm SGS Deutschland GmbH, Wasserburg (Inn). The output of this switching element, which is available as a structural unit, transmits an electric signal which is accurately proportional to the frequency of the input signal.

The storage members 138 and 139 are of identical design. Each of them consists of a rapidly controllable electronic switch, a storage capacitor and an operational amplifier with a very high ohmic input. The switch opens in response to the application of the signal from the monostable multivibrator 141 to its input during a precisely defined time period, so that a signal present at different input can be registered by the storage capacitor as a voltage value.

The signals SM1, SM2, which will be discussed presently, are supplied by the outputs c of the storage members 138 and 139.

The signal SM1, which corresponds to the frequency of the oscillating circuit 126 at the moment of resonance (resonance frequency), is determined by the capacitance of the measuring capacitor 125. This capacitance is influenced by the dielectric constant $\epsilon$ of the tobacco fibers in the tobacco stream 7 and the amount of moisture contained in the tobacco strand 7. Thus, the resonance frequency of the oscillating circuit 126 varies in dependence on the dielectric constant.

The signal SM2 which corresponds to the amplitude of the voltage (1 KHz) of the oscillating circuit 126 at the moment of resonance is a measure of damping of the oscillating circuit 126, which is determined via the ohmic losses in the dielectric of the measuring capacitor 125. The ohmic losses (tan $\delta$) are also influenced by the density of tobacco in the tobacco stream 7 and by the moisture content of tobacco.

The two values, the dielectric constant $\epsilon$ and the ohmic losses (indicated, among others, also as tan $\delta$), are indicators of different physical properties of the filler **7*a* which are differently influenced by the two substances of the combination located in the electric field of the measuring capacitor 125**.

This different influencing is to be understood in such a manner that the amounts of the two substances differently influence the ratio of the characteristic values $\epsilon$ and tan $\delta$ of the high-frequency oscillating circuit 126.

Inasmuch as, consequently, the dielectric constant $\epsilon$ as well as the loss angle tan $\delta$ of the dielectric of the measuring capacitor 125 are influenced, to different extents, by the density of tobacco and the amount of moisture contained therein, the signals SM1 or SM2 which are correspondingly dependent on the capacitance or on the tan $\delta$ (damping) of the oscillating circuit, can be utilized in an evaluating circuit 236 for automatic determination of the mass M1 of tobacco (and the moisture M2).

The density determination in the evaluating circuit 236 is based on the following considerations.

A functional relationship exists between the two values M1, M2 of the different substances "tobacco" and "moisture" and the values (signals) SM1 and SM2, which can be expressed in the general form of polynomial equations:

$$M_1 = a + b \cdot SM_1 + c \cdot SM_1^2 + d \cdot SM_1^3 + \ldots + n_{11} \cdot SM_1^n + e \cdot SM_2 + f \cdot SM_2^2 + g \cdot SM_2^3 + \ldots + n_{12} \cdot SM_2^n$$

$$M_2 = h + i \cdot SM_1 + j \cdot SM_1^2 + k \cdot SM_1^3 + \ldots + n_{21} \cdot SM_1^n + l \cdot SM_2 + m \cdot SM_2^2 + o \cdot SM_2^3 + \ldots + n_{22} \cdot SM_2^n.$$

To obtain a solution of these equations, it is first necessary to experimentally establish the relationship between M1, M2, and SM1, SM2. This can be accomplished in such a manner that M2, that is, the amount of the moisture in tobacco, is kept at a constant value.

Then, the values of the associated signals SM1 and SM2 are respectively measured at different M1 values (that is, tobacco density values). In this manner, there is obtained a first family of curves. In a similar manner, the density of the tobacco, that is M1, is subsequently kept constant, and M2, that is the amount of the moisture, is varied, while again the values of the associated signals SM1 and SM2 are measured. In this manner, there is obtained a second family of curves.

Now, there can be formed a matrix from the above-mentioned polynomials with powers of SM1 and SM2 which correspond to the number of the value pairs of SM1 and SM2. From this system of equations, there can be determined—possibly by means of a conventional desk calculator—the constants a . . . $n_{22}$ which are associated with the respective powers of the polynominals. The model 30 of the series 9800 of the firm Hewlett-Packard can be utilized as a desk calculation of this type. When the calculator is performed for a different number of value pairs and thus of powers, one can see which powers are needed for the achievement of a predetermined desired measuring accuracy. As an example, it can be assumed that already the third power brings about negligible values, so that it is only necessary to sense the coefficients a to c, e, f, h to j, l and m as constant determination values for the density M1 (and the amount m2) of a tobacco stream to be measured.

The above-mentioned coefficients are stored in coefficient storages 237*a* . . . 237*m* of the evaluating circuit 236 and they are transmittable, within the calculating cycles, to a calculator 238, to the inputs a1 and a2 of which the signals SM1 and SM2 are transmittable. The calculator 238 cyclically calculates, in accordance with a certain program, based on the signals which are transmitted to it and which correspond to the stored coefficients a . . . m, as well as based on the signals SM1 and SM2, the tobacco density M1 (and the amount M2) of (or in) the tobacco stream 7 which passes through the measuring capacitor 125. Calculating programs for automatic calculation of polynomials based on constant coefficients and known base numbers for powers are widely known and can be realized, in the terms of circuitry, e.g., by the above-mentioned desk calculator of the firm Hewlett-Packard. Then, signals can be derived from the outputs m1 and m2 of the calculator 238, and such signals correspond to the density M1 of the tobacco (or to the amount M2 of the moisture contained therein).

The idea on which the above-described circuitry is based is not limited to a reduction of the relations between density and measurement signals to polynomials of the n-th order. It is also possible, commencing from the families of curves for a density which is held constant and a varied amount, to select functions with similar characteristics and to transform them by iterative operations in a satisfactory mathematical expression, to store the corresponding constant determination values and to use the same for the automatic determination of the densities or amounts based on the signals SM1 and SM2.

A further possibility of arriving at the constant determination values resides in constantly feeding families of curves into a calculator by special feeding devices, for instance, based on scanning. The calculator then subsequently automatically arrives at a determination of the optimally approximated function and the constant determination values of the same.

When tobacco sorts and/or moisture contents are very different, it can be recommended to separately determine the functions (polynominals) and the constant coefficients for individual tobacco sorts. This is simplified by the fact that the individual tobacco mixtures may very strongly differ from one another, but that they are very homogeneous and constant within themselves.

The signal SM1 which corresponds to the density of the non-equalized tobacco stream 7 is transmitted to the input a of a function generator 61, to the inputs b of which there are transmitted the values for the desired rigidity G1 (soft), G2 (intermediate), G3 (rigid). In the manner which has been explained with reference to FIG. 7, the signal at the output c of the function generator 61 is transmitted as a desired value signal Ht to the input a of the signal comparing member or stage 47 which is incorporated in the position-regulating circuit and the input b of which receives a signal which is transmitted by the monitoring device 48, depends on the height Ht of the equalized tobacco filler 7*a* and corresponds to the actual value. The actual value signal Ht is again furnished by the device 48 for monitoring the distance between the location E and the conveyor belt 3.

The signal which appears at the output c of the stage 47 when a possible difference which corresponds to the regulating deviation, exists between the two signals that are supplied to the stage 47 is transmitted to the control arrangement 11 for the positioning motor 9 for adjustment of the position of the plane E of the equalizer 8 until coincidence of the desired and actual values is obtained.

The formation of a cigarette rod 7*b* and thus the production of cigarettes of constant rigidity (or constant quantity) is possible even in this manner.

The above-described so-called "advance controls" (also referred to as "anticipatory controls") of the removal location (removal plane) E of the equalizer 8 in dependence on signals which have been formed before the tobacco stream 7 has reached the removal location E, have the advantage that the tobacco filler *7a* can still be influenced. A disadvantage is that a supervision of the intervention is missing, which would be achievable only by means of a true regulation which, however, has the disadvantage of system-caused delays.

A regulation of the stream formation to achieve a constant rigidity of the cigarettes is illustrated in FIG. 10.

The signal which is transmitted by the monitoring device 22 and corresponds to the density or quantity Dg of tobacco in the equalized and densified cigarette rod *7b* is transmitted to the input a of a function generator 66 in which there are stored value pairs for different distances between the cutting plane E of the equalizer 8 and the conveyor belt 3, and thus for the height Ht of the equalized non-densified tobacco filler *7a*, in dependence on the density values of the equalized densified tobacco filler (cigarette rod *7b*). In addition thereto, signals corresponding to different rigidities G1, G2, G3 of the cigarettes, to which the cigarette production is to be controlled, can be transmitted to the corresponding inputs b of the function generator 66.

Part II of the diagram of FIG. 8 shows the relationship which is established by the function generator 66 between the input signals Dg that are transmitted by the monitoring device 22, the rigidity-dependent signals G1 (soft), G2 (intermediate), G3 (rigid), and the signals denoting the height Ht of the equalized non-densified tobacco filler *7a*.

The signal which is transmitted by the output c of the function generator 66 in an analog manner or calculated according to a program in correspondence with the predetermined function in a digital manner which corresponds to Ht is used within the regulating circuit for the control of the equalizing operation in the sense of maintaining the rigidity or the filling force of the equalized densified tobacco rod *7b* and thus of the finished cigarettes 15 at a constant value.

The signal at the output c of the function generator 66 is transmitted, after comparison with a desired value signal (which is furnished by a desired value generator 66) in a comparing stage 66*b*, as a desired value to a regulating circuit for the height Ht of the equalized non-densified filler *7a*. Advantageously, a position-regulating circuit for the distance between the removal location (cutting plane) E of the equalizer 8 and the conveyor belt 3 is suited for this purpose, inasmuch as such circuit simultaneously determines the height Ht of the equalized non-densified tobacco filler *7a*. The signal at the output c of the function generator 66 is transmitted as a desired value signal to the input a of a comparing member 67 of the position-regulating circuit. The input b of the comparing member 67 receives a signal which corresponds to the height Ht of the equalized non-densified filler *7a*. This signal can be transmitted by the optoelectronic arrangement 17' which is constructed in the same manner as the one which is illustrated in FIG. 2. However, it is more advantageous to form the signal in dependence on the position of the cutting plane E (removal location) of the equalizer 8, inasmuch as such position simultaneously constitutes a measure for the height Ht of the equalized non-densified tobacco filler *7a*. To this end, there serves a height monitoring device 48 the output signal of which is transmitted to the input b of the comparing member 67. As already mentioned, the device 48 can be a conventional, inductively operating displacement-measuring signal generator in which a piece of iron influences the inductivity of a coil in dependence on the position of the iron.

A possible difference between the two signals, which are transmitted to the comparing member 67, is transmitted as a position regulating deviation to the control arrangement 11 which so controls the positioning motor 9 of the equalizer 8 that the actual position of the cutting plane E eventually coincides with the desired position as indicated by the control signal which is furnished by the function generator and corresponds to Ht (desired value signal in the position-regulating circuit).

It is possible, by this true regulation, to compensate for long-lasting inaccuracies of the "advance controls", which latter are controlled by the signals transmitted by the monitoring device 17, 18 or 20, and to assure, over a long time span, the production of cigarettes of constant ridigity.

A switching arrangement 68 renders it possible to supply the signal corresponding to the density of the cigarette rod *7b* directly, i.e., via conductor 69 which is shown by broken lines, from the monitoring device 22 to the comparing member 67, when the advance controls (anticipatory controls) which are effected by the monitoring devices 17, 18 and 20 are to be carried out in the sense of amount regulation. Such controls to ensure a constant quantity of tobacco (instead of rigidity) in the cigarettes are possible in accordance with the previous description. As a result of the possibility of switching, the controls or regulations can thus be selectively operated for constant rigidities of the cigarettes or for constant quantities of tobacco in the cigarettes, in accordance with the desire of the cigarette manufacturer.

It lies within the framework of the invention to correct the functions given in the individual function generators in the sense of taking into consideration varying tobacco temperatures, which can be accomplished by program-controlled function generators in a relatively simple manner. This can be advantageous inasmuch as pronounced temperature variations can render the signals of the monitoring devices 17, 18 and 29 in controls or regulations to constant rigidity inaccurate or misrepresentative.

In addition thereto, it is possible to provide a limiting value generator 71 which transmits to the control arrangement 11 upper (line 72) and lower (line 73) limiting value or threshold signals for the amount which must be exceeded or fallen below even when the rigidity is regulated. When one of these limits is reached, the stream formation is continued with the corresponding limiting value.

Furthermore, it lies within the framework of the invention to control or regulate the manufacture of other rod-shaped objects which are manufactured in tobacco-handling industry from a material which is suitable for smoking, e.g., cigars or cigarillos, in the manner according to the invention.

Finally, it is within the purview of the invention to control or regulate the manufacture of other rod-shaped articles which are produced in the tobacco-handling industry, for example, of filter plugs, in accordance with the invention provided that a part of the material is to be removed during the manufacture with the purpose of equalizing the stream.

FIG. 10*a* illustrates a modification of the arrangement which is shown in FIG. 10. The density-dependent signals which are transmitted by monitoring device 22, on the one hand, and strand height-dependent signals which are transmitted by the monitoring device 48, on the other hand, are furnished to the function generator 66. The function generator 66 then forms and transmits analog or digital signals which correspond to the rigidity of the unwrapped stream, in accordance with a program which corresponds to a predetermined functional relationship between the two input signals. Those output signals of the function generator 66 which correspond to the rigidity are transmitted not only to the comparing member 66*b* but also to a deviation calculator 66*c* for the determination of the deviation of the rigidity-dependent signal transmitted by the function generator 66. The output signal of the deviation calculator 66*c* is applied to a function generator 66*d* which so influences a desired value generator 66*a* that the intensity of the rigidity-dependent desired value transmitted by the latter increases with increasing deviation, and diminishes with diminishing deviation (target shifting). In this manner, it can be achieved that always approximately the same number of articles (cigarettes) statistically lies outside of a predetermined limit which can, for instance, be designated as "limit of unacceptability".

In order to avoid the possibility that certain weight limits would be exceeded, there can be provided a limiting member 66*e* which prevents deviations of the desired value beyond certain limits.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of producing an elongated filler from fibers, especially tobacco fibers, comprising the steps of continuously converting the fibers into an elongated stream which contains a surplus of fibers and advancing the stream lengthwise; equalizing the advancing stream, including removing the surplus of fibers therefrom; densifying and wrapping the equalized stream to convert the stream into the filler; generating a signal in dependence on the height of the stream prior to said equalizing step; and controlling said equalizing step in dependence on said signal.

2. The method as defined in claim 1, wherein said signal generating step includes monitoring the height of the stream prior to said equalizing step in a contactless manner.

3. The method as defined in claim 2, wherein said monitoring step includes passing the stream across the path of light rays travelling between a source and a signal generating receiver of light rays so that the travel of light rays is obstructed to an extent which is commensurate with the height of the stream and the receiver generates electric signals in dependence on the amount of light impinging upon the receiver.

4. The method as defined in claim 3, wherein the signals which are transmitted by the receiver are analog signals.

5. The method as defined in claim 3, wherein the signals which are transmitted by the receiver are digital signals.

6. The method as defined in claim 1, further comprising the steps of correcting said signal in accordance with a function which is selected for a desired value of the rigidity or mass flow of the filler and represents a predetermined relationship between the height of the equalized stream prior to said densifying step and said signal, generating a control signal in dependence on the corrected first mentioned signal, and regulating said controlling step so as to maintain the rigidity or the mass flow of the filler at a constant value.

7. The method as defined in claim 1, further comprising the steps of generating a second signal denoting the resistance of the stream to the flow of a gaseous fluid and influencing said equalizing step in dependence on said second signal.

8. The method as defined in claim 7, wherein said step of generating said second signal includes passing an air current through the stream transversely of the direction of advancement of the stream.

9. The method as defined in claim 1, further comprising the steps of generating a second signal denoting the resistance of the stream to the flow of a gaseous fluid prior to said equalizing step, generating a third signal denoting the height of the equalized stream prior to said densifying step and generating a fourth signal denoting the density of the stream prior to said equalizing step in accordance with a function which represents a predetermined relationship between said first mentioned, third and fourth signals, said controlling step including generating a control signal for anticipatory regulation of said equalizing step including correcting said fourth signal in dependence on a function which is selected for a desired rigidity or mass flow of the filler and represents a predetermined relationship between said third and fourth signals.

10. The method as defined in claim 1, wherein said controlling step includes generating an actual value signal in dependence on the height of the equalized stream prior to said densifying step, generating a control signal in dependence on said first mentioned signal, comparing said actual value signal with said control signal and changing the position of the location at which said equalizing step is performed relative to the stream when said control signal deviates from said actual value signal.

11. The method as defined in claim 10, wherein said step of generating said actual value signal includes monitoring the position of said location relative to the stream.

12. The method as defined in claim 10, wherein said step of generating said actual value signal includes sensing the height of the stream in a contactless manner.

13. The method as defined in claim 1, further comprising the step of additionally controlling said equalizing step, including generating a second signal denoting the mass flow of the equalized stream, generating a third signal denoting the height of the equalized stream prior to said densifying step and correcting said second signal in dependence on a function which is selected for a desired value of the rigidity or mass flow of the filler and represents a predetermined relationship between said second and third signals to form a control signal for additional control of the equalizing step.

14. The method as defined in claim 13, further comprising the steps of comparing said third signal with said control signal and changing the position of the location at which said equalizing step is performed relative to the stream when said control signal deviates from said third signal.

15. The method as defined in claim 14, wherein said step of generating said third signal includes monitoring the position of said location relative to the stream.

16. The method as defined in claim 14, wherein said step of generating said third signal includes monitoring the height of the stream in a contactless manner.

17. The method as defined in claim 13, further comprising the step of discontinuing said additional control when the mass flow of the filler is constant.

18. Apparatus for producing an elongated filler from fibers, especially tobacco fibers, comprising a conveyor; means for continuously supplying to said conveyor fibers which accumulate on said conveyor and form an elongated stream which contains a surplus of fibers and advances with said conveyor lengthwise; means for equalizing the advancing stream, including means for removing the surplus of fibers therefrom; means for densifying and wrapping the equalized stream to convert the stream into the filler; means for monitoring the height of the stream at right angles to the direction of advancement thereof and upstream of said equalizing means, including means for generating signals denoting the height of the stream; and means for controlling the distance between said equalizing means and said conveyor in dependence on said signals.

19. The apparatus as defined in claim 18, wherein said height monitoring means includes a contactless monitoring device.

20. The apparatus as defined in claim 19, wherein said contactless monitoring device includes a source of light rays and a receiver for light rays which issue from said source and traverse the path of the stream so that the latter intercepts the rays to an extent which is dependent on the height of the stream, said receiver constituting said means for generating said signals and such signals being generated in dependence on the amount of light reaching said receiver.

21. The apparatus as defined in claim 20, wherein said receiver is arranged to transmit analog electric signals.

22. The apparatus as defined in claim 20, wherein said receiver is arranged to transmit digital signals.

23. The apparatus as defined in claim 20, further comprising means for generating second signals denoting the height of the equalized stream upstream of said densifying means and a function generator connected to said monitoring device and to said means for generating said second signals and operative to generate an output signal in accordance with a function which represents, for the desired rigidity or mass flow of the filler, a predetermined relationship between said first mentioned and said second signals, and means for transmitting said output signal from said function generator to said controlling means.

24. The apparatus as defined in claim 18, further comprising means for monitoring the resistance of said stream to the flow of a gaseous fluid upstream of said equalizing means and in a direction transversely of the direction of advancement of the stream, including means for generating a second signal denoting the resistance of the stream to such flow, and means for transmitting said second signal to said controlling means.

25. The apparatus as defined in claim 24, wherein said resistance monitoring means includes a suction chamber.

26. The apparatus as defined in claim 24, wherein said transmitting means includes a function generator connected to said resistance monitoring means and operative to generate an output signal in accordance with a function which represents, for the desired rigidity or mass flow of the filler, a predetermined relationship between the height of the equalized stream upstream of said densifying means and the second signal, and means for applying said output signal to said controlling means as a control signal for the height of the equalized stream upstream of said densifying means.

27. The apparatus as defined in claim 26, further comprising signal-responsive means for changing the location of said equalizing means, said function generator constituting a desired value signal generator for said location changing means.

28. The apparatus as defined in claim 18, further comprising means for generating second signals denoting the height of the equalized stream upstream of said densifying means and means for monitoring the resistance of the stream to the flow of a gaseous fluid upstream of said equalizing means, said resistance monitoring means including means for generating a third signal denoting the monitored resistance, a first function generator connected to both said monitoring means and operative to generate a first output signal in accordance with a function which represents, for the desired rigidity or mass flow of the filler, a predetermined relationship between the density of the equalized stream upstream of said densifying means and said first mentioned and third signals, a second function generator connected to said first function generator and operative to generate a second output signal in correspondence with a function which represents, for the desired rigidity or mass flow of the filler, a predetermined relationship between said second signals and the density of the stream upstream of said equalizing means, and means for transmitting said second output signal to said controlling means as a control signal for the height of the equalized stream upstream of said densifying means.

29. The apparatus as defined in claim 28, further comprising signal-responsive means for changing the location of said equalizing means, said second function generator constituting a desired value signal generator for said location changing means.

30. The apparatus as defined in claim 18, wherein said controlling means includes signal-responsive means for changing the location of said equalizing means, said height monitoring means constituting an actual value signal generator for said location changing means.

31. The apparatus as defined in claim 30, wherein said actual value signal generator is a contactless monitoring device.

32. The apparatus as defined in claim 30, wherein said actual value signal generator is an arrangement for sensing the position of the location of said equalizing means relative to said conveyor.

33. The apparatus as defined in claim 18, further comprising means for measuring the mass flow of the filler, including means for generating a second signal which is indicative of the mass flow, a function generator connected to said last mentioned signal generating means and operative to generate an output signal in correspondence with a function which represents, for a desired value of rigidity or mass flow of the filler, a predetermined relationship between the height of the equalized steam upstream of said densifying means and the second signal, and means for applying said output signal to said controlling means as a control signal for the height of the equalized stream upstream of said densifying means.

34. The apparatus as defined in claim 33, further comprising signal-responsive means for changing the location of said equalizing means, said function generator constituting a desired value signal generator for said location changing means.

35. The apparatus as defined in claim 34, further comprising means for sensing the height of the equalized stream, said height sensing means constituting an actual value signal generator for said location changing means.

36. The apparatus as defined in claim 35, wherein said height sensing means is a contactless monitoring device.

37. The apparatus as defined in claim 35, wherein said height sensing means constitutes an arrangement for monitoring the position of the location of said equalizing means relative to said conveyor.

38. The apparatus as defined in claim 33, further comprising means for determining the fluctuations of the output signal of said function generator, an additional function generator connected to said determining means, and a desired value signal generator connected to said additional function generator, said additional function generator being operative to control said desired value signal generator so that the intensity of the desired value signal increases with increasing, and diminishes with diminishing, value of fluctuation of the signal at the output of said first mentioned function generator.

* * * * *